US007651446B1

(12) United States Patent
Eschenbach

(10) Patent No.: US 7,651,446 B1
(45) Date of Patent: Jan. 26, 2010

(54) ELLIPTICAL CORE CYCLE EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 0 days.

(21) Appl. No.: 12/291,690

(22) Filed: Nov. 13, 2008

(51) Int. Cl.
*A63B 22/00* (2006.01)
*A63B 22/04* (2006.01)
*A63B 26/00* (2006.01)

(52) U.S. Cl. ..... 482/52; 482/51; 482/140

(58) Field of Classification Search ..... 482/51–52, 482/57, 70, 79–80, 140
See application file for complete search history.

(56) References Cited

U.S. PATENT DOCUMENTS

| | | | | |
|---|---|---|---|---|
| 4,387,894 | A | 6/1983 | Baumann | 272/130 |
| 4,586,706 | A | 5/1986 | Chen | 272/73 |
| 4,799,475 | A * | 1/1989 | Iams et al. | 601/23 |
| 4,930,769 | A | 6/1990 | Nenoff | 272/120 |
| 5,100,131 | A | 3/1992 | Fong | 482/112 |
| 5,499,961 | A | 3/1996 | Mattox | 482/132 |
| 5,518,483 | A | 5/1996 | Oswald | 482/131 |
| 5,549,527 | A | 8/1996 | Yu | 482/57 |
| 5,620,403 | A | 4/1997 | Lundin | 482/96 |
| 5,931,765 | A | 8/1999 | Huang | 482/57 |
| 6,419,613 | B2 | 7/2002 | Stearns et al. | 482/57 |
| 6,440,045 | B1 | 8/2002 | Gaston | 482/140 |
| 6,488,640 | B2 | 12/2002 | Hood, Jr. et al. | 601/23 |
| 7,232,404 | B2 | 6/2007 | Nelson | 482/140 |
| 7,285,076 | B2 | 10/2007 | Kelly | 482/57 |
| 7,611,445 | B2 * | 11/2009 | Brown et al. | 482/51 |
| 2003/0083177 | A1 * | 5/2003 | Tung | 482/51 |
| 2004/0077468 | A1 | 4/2004 | Myles | 482/140 |
| 2005/0079964 | A1 | 4/2005 | Francavilla | 482/142 |
| 2007/0149370 | A1 | 6/2007 | Brown et al. | 482/140 |
| 2008/0070765 | A1 | 3/2008 | Brown et al. | 482/140 |
| 2008/0070766 | A1 | 3/2008 | Brown et al. | 482/140 |
| 2008/0200317 | A1 * | 8/2008 | Campanaro et al. | 482/140 |
| 2008/0207415 | A1 * | 8/2008 | Tsai | 482/147 |
| 2009/0048074 | A1 * | 2/2009 | Kamins | 482/52 |

* cited by examiner

*Primary Examiner*—Steve R Crow

(57) ABSTRACT

The present invention relates to a core exercise apparatus that combines lower arm movements with knee movements to exercise the core muscles of an operator in a cyclic manner. More particularly, the present invention is associated with an exercise apparatus having a separately supported knee platform for a portion of an operator coordinated with the motion of a lower arm platform. Further, the knees of the operator follow an elliptical curve path in concert with the up and down movements of the lower arm platform to drive a flywheel for cardio core exercise of the abdominal, lower and upper back muscles. The obliques may also be exercised by a reposition of the lower legs on the knee platform.

20 Claims, 5 Drawing Sheets

ELLIPTICAL CORE CYCLE EXERCISE APPARATUS

BACKGROUND OF THE INVENTION

1. Field

The present invention relates to a core exercise apparatus that combines lower arm movements with knee movements to exercise the core muscles of an operator in a cyclic manner. More particularly, the present invention is associated with an exercise apparatus having a separately supported knee platform for a portion of an operator coordinated with the motion of a lower arm platform. Further, the knees of the operator follow an elliptical curve path in concert with the up and down movements of the lower arm platform to drive a flywheel for cardio core exercise of the abdominal, lower and upper back muscles. The obliques may also be exercised by a reposition of the lower legs on the knee platform.

2. State of the Art

The benefits of regular exercise to improve overall health, appearance and longevity are well documented in the literature. For exercise enthusiasts the search continues for safe apparatus that provides total body exercise for maximum benefit in minimum time.

The prior art is abundant with apparatus intending to exercise the abdominal muscles. A category of abdominal exercise apparatus with the user in a prone position and having a moving knee platform follow. Nenoff in U.S. Pat. No. 4,930,769 shows a slanted beam acting as a track for a moving knee platform to be used with a fixed handle. Mattox in U.S. Pat. No. 5,499,961 shows a knee support to be used with a rolling handle against resistance. Oswald in U.S. Pat. No. 5,518,483 shows a track having both knee pad and handle on rollers for reciprocating motions. Lundin in U.S. Pat. No. 5,620,403 displays a sliding exercise apparatus inclined with cables for various types of exercise. Gaston in U.S. Pat. No. 6,440,045 shows a platform on rollers to be used with a fixed body support that can be used with either the knees moving or the hands moving.

Myles et al. in U.S. Pat. Application No. 2004/0077468 shows a handle and knee platform both on rollers coordinated with cables. Nelson in U.S. Pat. No. 7,232,404 shows a knee platform with rollers on an inclined track and a pivotable arm support. Brown et al. in U.S. Pat. Applications 2007/0149370, 2008/0070765 and 2008/0070766 show a knee platform on rollers supported by an inclined curved track and generally a fixed handle offered in the industry as the Ab Coaster.

The prior art contains a number of exercise apparatus intended to exercise the back muscles. Kelly in U.S. Pat. No. 7,285,076 shows an oscillating exercise machine where a crank is used to pump hydraulic fluid for oscillation of a carriage resulting in exercise for the abdominal and back muscles. Stearns et al. in U.S. Pat. No. 6,419,613 shows an exercise apparatus with a foot crank to elevate a seat. Yu in U.S. Pat. No. 5,549,527 displays a stationary bike where the seat and handles oscillate with the use of a foot pedal to exercise a variety of muscles.

Huang in U.S. Pat. No. 5,931,765 also shows a foot crank that moves a seat and handle. Chen in U.S. Pat. No. 4,586,706 also shows a foot crank that moves a seat and handle for exercise. Baumann in U.S. Pat. No. 4,387,894 shows a bench type exerciser for back exercise. Fong in U.S. Pat. No. 5,100,131 shows a back muscle exercising and stretching apparatus with a stationery seat and moving backrest. Hood, Jr. et al. in U.S. Pat. No. 6,488,640 gives a method and device for back exercise using continuous passive lumbar motion. Another back exerciser is proposed by Francavilla in U.S. Pat. Application 2005/0079964 as a spherical back exercise apparatus.

There remains a need to combine the benefits of upper body motion with lower body motion into cardio core exercise that can elevate the heart rate of the operator. There also remains a need for a cardio core exercise apparatus whereby the intensity of exercise can be adjusted to suit the needs of each operator.

SUMMARY OF THE INVENTION

The present invention relates to the kinematic motion control of lower arm platform motion with knee platform motion where the knee platform supports the knees and lower legs of an operator. More particularly, apparatus is provided that offers abdominal exercise, lower back exercise, shoulder exercise and arm exercise in a cardio cycle to drive a flywheel against resistance.

The core cycle exercise apparatus comprises a knee platform to support the knees and lower legs of an operator and a lower arm platform with hand grips to support the lower arms of an operator. The knee platform follows generally back and forth movements along an elliptical curve path while the lower arm platform follows coordinated generally up and down movements.

A pair of crank arms connected to rotate about a pivot axis positioned upon a framework couple the motions of the lower arm platform to the knee platform. The lower arm platform is connected to one crank arm with a connecting link. A coupler link is connected to the other crank arm and a guide to support the knee platform. A flywheel is driven by the crank arms to smooth out the combined motions of the platforms.

To begin operation of the core cycle, an operator places both knees and lower legs upon the knee platform in a lowermost position with the feet rearward. The lower arms are positioned upon the lower arm platform in the uppermost position with hands gripping the hand grips with the back of the operator in a generally erect position. Upper body weight imposed upon the lower arm platform causes downward movement of the lower arm platform with a corresponding rearward movement of the knee platform along the lower portion of an elliptical curve path. As the lower arm platform approaches the lowermost position, the knee platform arrives upon the uppermost portion of the elliptical curve path. Lower body weight in conjunction with the abdominal muscles impose a force upon the knee platform which causes the knee platform to move forward and downward while returning the lower arm platform to the uppermost position to complete the cycle of movements.

The elbows approach the knees of the operator when the knee platform is most forward. Upper back muscles are used to drive the lower arm platform downward while the abdominal muscles are used to drive the knee platform forward against resistance. Lower back muscles are used to raise the lower arm platform. Thus, the core muscles are exercised in a cyclic manner to repetitively move the platforms as a cardio exercise to elevate the heart rate. Alternately, the lower legs may be positioned approximately 45 degrees across the knee platform to exercise the obliques for additional core exercise.

Several linkage variations are given in the embodiments to support the knee platform. Adjustments can be made to the crank arms, linkage and framework to vary the intensity of exercise.

In summary, this invention provides the operator with cardio core exercise resulting from the operator driving the lower arm platform and knee platform through repetitive cycles against resistance. Exercise intensity is adjustable either by resistance devices, changes in linkages or incline of the framework.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with additional specificity and detail through use of the accompanying drawings in which:

DETAILED DESCRIPTION OF THE EMBODIMENT

Figure 1:
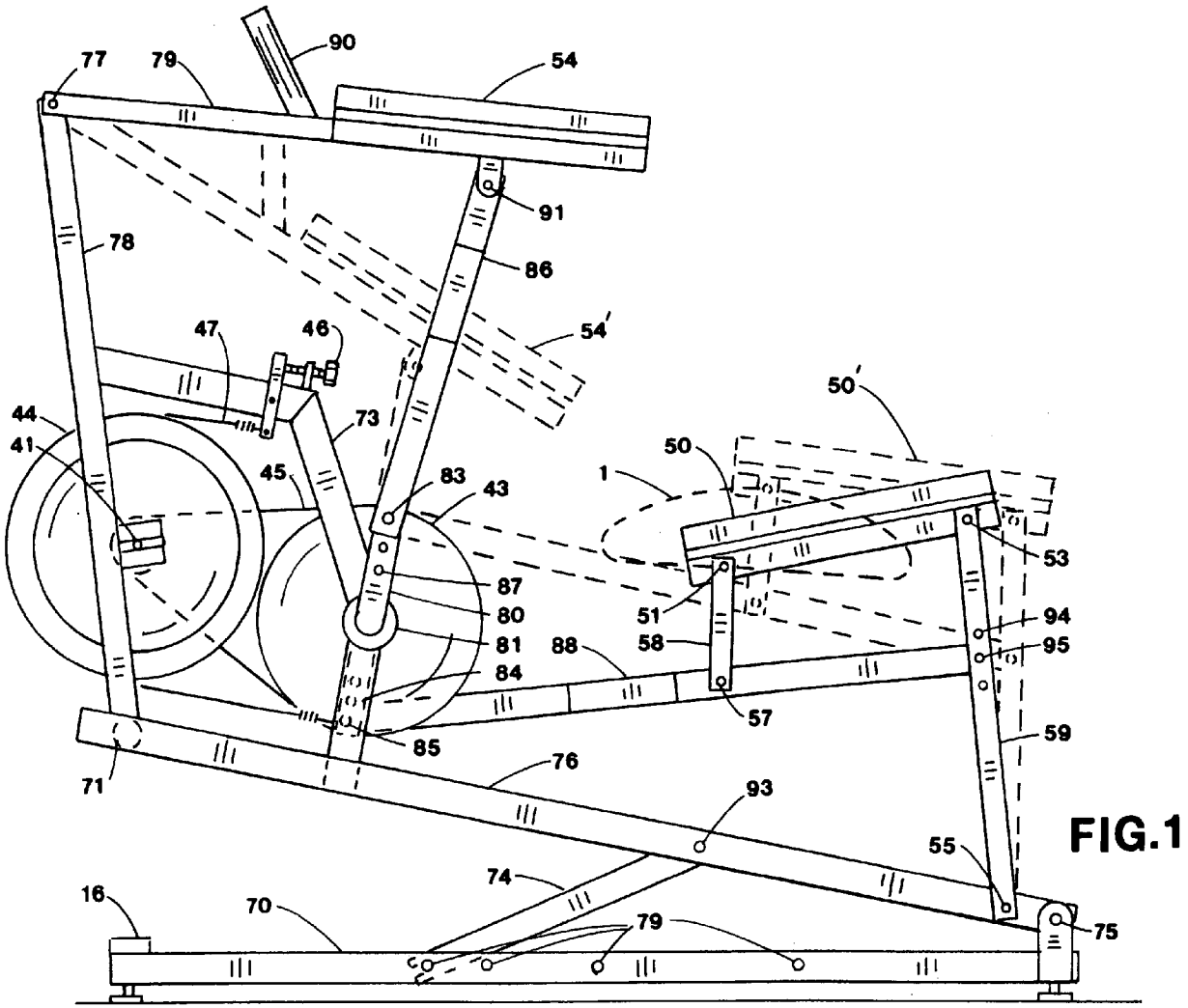
FIG. 1 is a left side elevation view of the preferred embodiment of the exercise apparatus constructed in accordance with the present invention.
Figure 2:
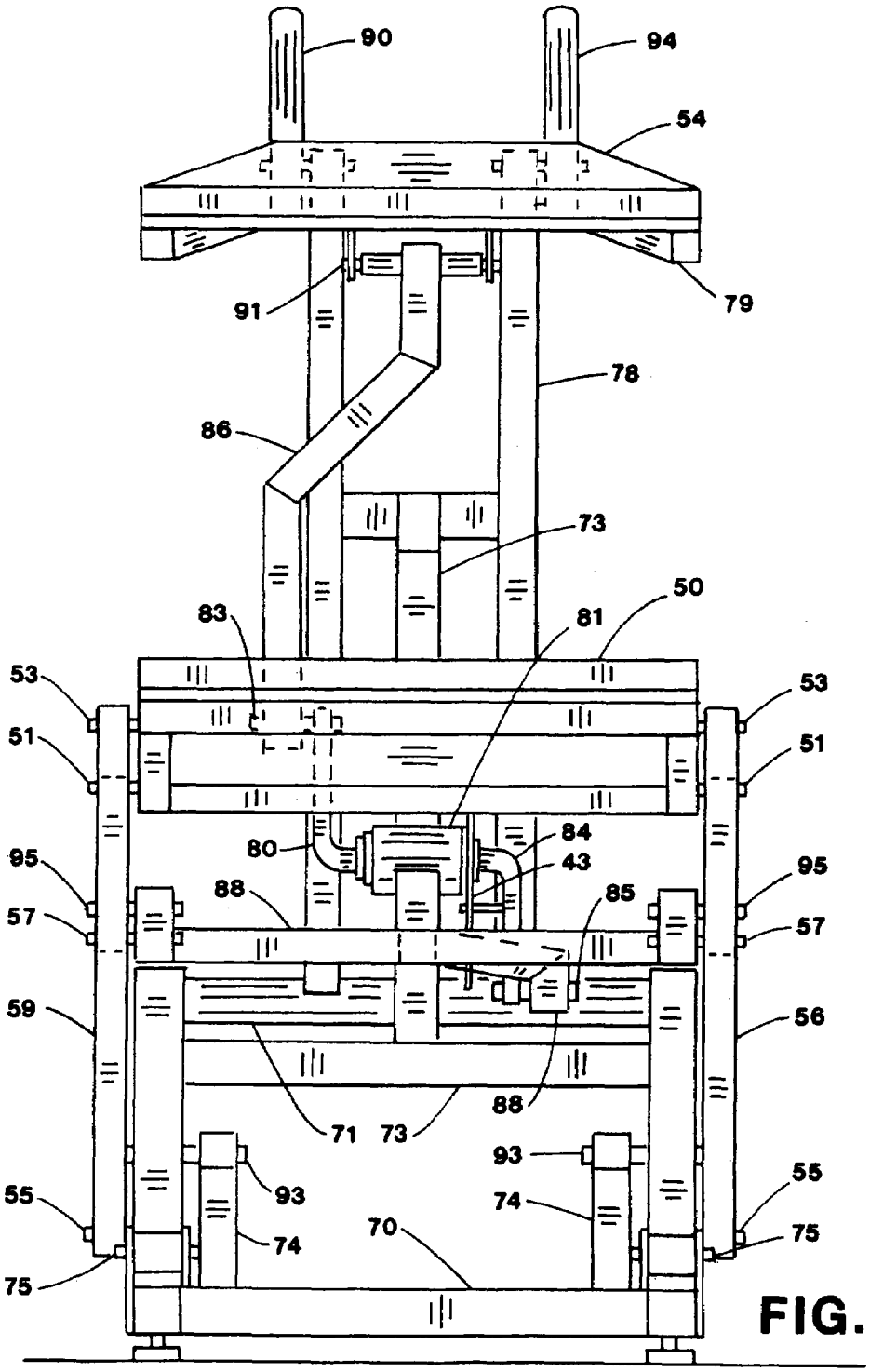
FIG. 2 is a rear view of the preferred embodiment shown in FIG. 1.

Referring to the drawings in detail, the preferred embodiment is shown in FIGS. 1 and 2 with lower arm platform 54 in the uppermost position attached to upper link 79. Hand grips 90,94 are also attached to upper link 79 which is connected to frame member 78 at pivot 77. Connecting link 86 is connected to upper link 79 at pivot 91 and to crank arm 80 at pivot 83. Crank arms 80,84 are connected in generally opposing directions at pivot axis 81 positioned upon frame member 73.

Guides 59,56 are connected to frame member 76 at pivots 55. Coupler link 88 is connected to guides 59,56 at pivots 95 and to crank arm 84 at pivot 85. Knee platform 50 is connected to guides 59,56 at pivots 53 in a lower position. Knee links 58,60 are connected to knee platform 50 at pivots 51 and to coupler link 88 at pivots 57. Knee link pivots 51 follow elliptical curve path 1 as crank 84 rotates about pivot axis 81 whereby lower arm platform 54 moves up and down about pivot 77. Coupler link 88 can be repositioned upon guides 59,56 to one of the additional holes 94 to change the elliptical curve path 1. Both crank arms 80,84 have additional holes 87 whereby the lengths of crank arms 80,84 may be changed to vary the motions of either platform. The lowermost position of lower arm platform 54' is shown with the corresponding uppermost position of knee platform 50'.

Sprocket 43 is connected to crank arms 80,84 and drives flywheel 44 about flywheel axis 41 with chain 45. Belt 47 engages flywheel 44 for resistance which may be adjusted with knob 46. Frame members 78,73,71,76 are connected with pivot axis 81. Frame member 76 is connected to floor support 70 at pivot 75. Adjustable support 74 is connected to frame member 76 at pivot 93 and engaged with one of support rods 79. Moving adjustable support 74 to another support rod 79 will change the incline of frame member 76 to vary the intensity of exercise for an operator. Frame member 76 can be lowered to contact cushion 16 to become parallel to frame member 70.

Figure 3:
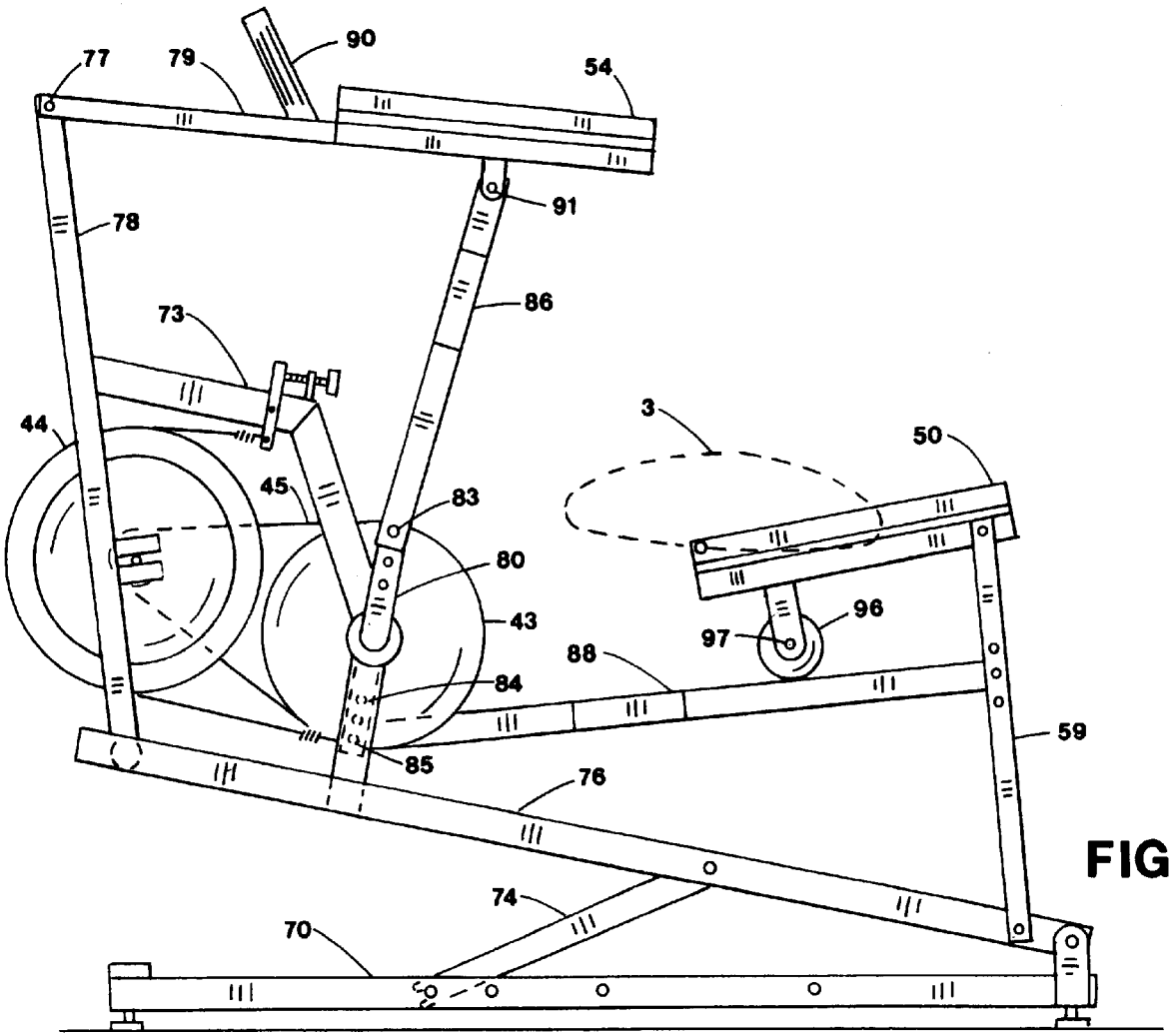
FIG. 3 is a left side view of an alternate embodiment of FIG. 1.

An alternate embodiment is shown in FIG. 3 with the lower arm platform 54 in the uppermost position. Knee links 58 of the preferred embodiment are replaced by rollers 96 connected to knee platform 50 at pivots 97. Rollers 96 are in rollable contact with coupler link 88. Knee platform 50 follows elliptical curve path 3 when crank 84 is rotated through a cycle. The remainder of the alternate embodiment is the same as the preferred embodiment shown in FIGS. 1 and 2.

Figure 4:
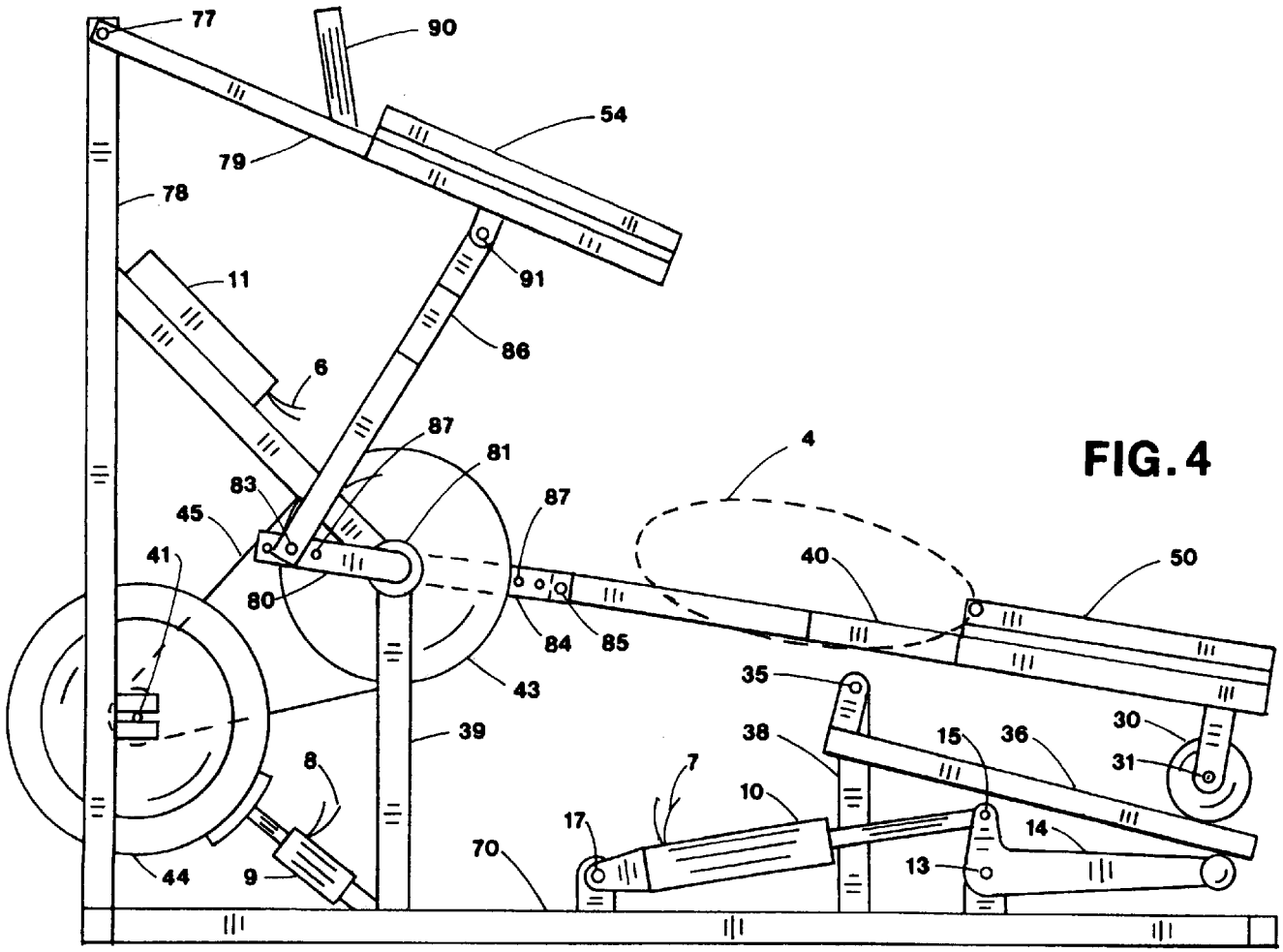
FIG. 4 is a left side view of another alternate embodiment of FIG. 1.

Another alternate embodiment is shown in FIG. 4 with knee platform 50 in the rearmost position and lower arm platform 54 in an intermediate position. Guides 59,56 of the preferred embodiment have been replaced with rollers 30 connected to coupler link 40 at pivots 31. Knee platform 50 is also attached to coupler link 40. Rollers 30 are in rollable contact with guide tracks 36. Guide tracks 36 are connected to frame member 38 at pivot 35 and supported by adjustment link 14. Adjustment link 14 is connected to frame member 70 at pivot 13 and to guide actuator 10 at pivot 15. Actuator 10 is connected to frame member 70 at pivot 17. Brake actuator 9 applies adjustable resistance to flywheel 44 to vary the intensity of exercise.

Control system 11 is attached to frame member 39 and connected with wires 6 to wires 8 of brake actuator 9 and to guide actuator 10 with wires 7 using conventional electrical wiring. Elliptical knee path 4 is followed by knee platform 50 as roller 30 moves back and forth along guide track 36 while crank arm 84 rotates. The lower arm platform 54 is similar to the preferred embodiment. Crank arms 80,84 have additional holes 87 to independently vary the length of crank arms 80,84 to change the up and down stroke of lower arm platform 54 or the size of the elliptical knee path 4.

Figure 5:
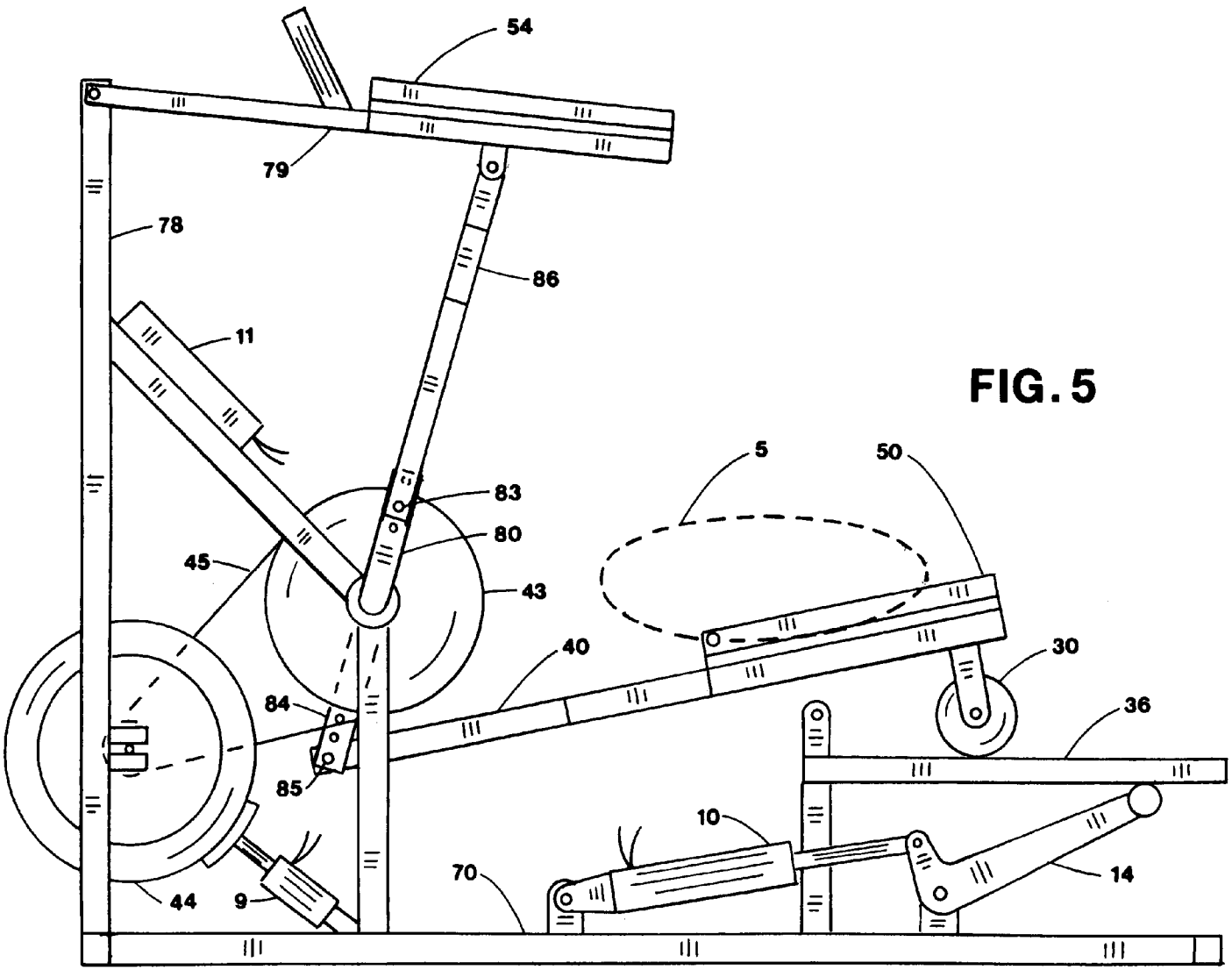
FIG. 5 is a left side view of the alternate embodiment shown in FIG. 4 positioned with the guide track elevated.

FIG. 5 is the same embodiment as FIG. 4 with lower arm platform 54 in the uppermost position and knee platform 50 in an intermediate position. Control system 11 has been activated to change the length of guide actuator 10 to raise guide track 36. Knee platform 50 now follows elliptical curve path 5.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus configured for core muscle exercise of an operator; a framework, said framework configured to support said exercise apparatus; a pair of crank arms, said crank arms being connected to rotate about a pivot axis positioned upon said framework; a lower arm platform for directly supporting both arms of an operator, said lower arm platform pivotally connected to said framework and one of said crank arms configured to follow generally up and down movement; a knee platform for directly supporting both knees of an operator, said knee platform connected to said framework and the other said crank arm configured for generally back and forth movement;

wherein a downward force applied upon said lower arm platform in combination with a force applied upon said knee platform by said operator causes said crank arms to rotate about said pivot axis whereby the knees of said operator follow an elliptical curve path.

2. The exercise apparatus according to claim 1 further comprising a roller, said roller operably associated with said knee platform.

3. The exercise apparatus according to claim 1 further comprising an adjustable resistance device, said adjustable resistance device operably associated with said crank arms and said framework.

4. The exercise apparatus according to claim 1 wherein said crank arms have adjustable length to vary the motions of either platform.

5. The exercise apparatus according to claim 1 wherein a portion of said framework may be inclined whereby the orientation of said operator may be varied to cause the amount of effort for exercise to change.

6. The exercise apparatus according to claim 1 further comprising a guide, said guide operably associated with said knee platform and said framework.

7. The exercise apparatus according to claim 6 further comprising a coupler link, said coupler link pivotally connected to one of said crank arms and operably associated with said guide.

8. The exercise apparatus according to claim 1 further comprising a connector link, said connector link pivotally connected to one of said crank arms and operably associated with said lower arm platform.

9. The exercise apparatus according to claim 1 further comprising a pair of hand grips, said hand grips attached to said lower arm platform.

10. The exercise apparatus according to claim 1 further comprising a flywheel, said flywheel operably associated with said crank arms and said framework.

11. An exercise apparatus configured for core muscle exercise of an operator; a framework, said framework configured to support said exercise apparatus; a pair of crank arms, said crank arms being connected to rotate about a pivot axis positioned upon said framework; a lower arm platform for directly supporting both arms of an operator, said lower arm platform pivotally connected to said framework configured to follow generally up and down movement; a connector link, said connector link pivotally connected to one of said crank arms and to said lower arm platform; a knee platform for directly supporting both knees of an operator, said knee platform connected to said framework configured for generally back and forth movement; a coupler link, said coupler link pivotally connected to the other said crank arm and operably associated with said knee platform;

wherein a downward force applied upon said lower arm platform in combination with a force applied upon said knee platform by said operator causes said crank arms to rotate about said pivot axis whereby the knees of said operator move towards the elbows of said operator to exercise the core muscles.

12. The exercise apparatus according to claim 11 further comprising a control system, said control system positioned on said framework and operably associated with the exercise intensity of said exercise apparatus.

13. The exercise apparatus according to claim 11 further comprising an adjustable resistance device, said resistance device operably associated with said crank arms and said framework.

14. The exercise apparatus according to claim 11 further comprising a guide, said guide operably associated with said knee platform and said framework.

15. The exercise apparatus according to claim 11 further comprising a flywheel, said flywheel operably associated with said crank arms and said framework.

16. An exercise apparatus configured for core muscle exercise of an operator; a framework, said framework configured to support said exercise apparatus; a pair of crank arms, said crank arms being connected to rotate about a pivot axis positioned upon said framework; an arm platform for directly supporting both arms of an operator, said arm platform having a pair of hand grips and being pivotally connected to said framework configured to follow generally up and down movement; a connector link, said connector link pivotally connected to one of said crank arms and to said arm platform; a knee platform for directly supporting both knees of an operator, said knee platform connected to said framework configured for generally back and forth movement; a coupler link, said coupler link pivotally connected to the other said crank arm and operably associated with said knee platform; a guide, said guide operably associated with said knee platform and said framework;

wherein a downward force applied upon said arm platform in combination with a force applied upon said knee platform by said operator causes said crank arms to rotate about said pivot axis whereby the knees of said operator move towards the elbows of said operator to exercise the core muscles.

17. The exercise apparatus according to claim 16 further comprising an adjustable resistance device, said resistance device operably associated with said crank arms and said framework.

18. The exercise apparatus according to claim 16 further comprising a flywheel, said flywheel operably associated with said crank arms and said framework.

19. The exercise apparatus according to claim 16 further comprising a guide adjustment means, said guide adjustment means configured to change the orientation of the path followed by said knee platform.

20. The exercise apparatus according to claim 16 further comprising a pair of rollers, said pair of rollers attached to said knee platform and operably associated with said coupler link.

* * * * *